United States Patent [19]

Antal et al.

[11] 4,456,259

[45] Jun. 26, 1984

[54] BOARD GAME

[76] Inventors: Leonard L. Antal, c/o Total Games, Inc., 1114 S. Austin Blvd., Oak Park, Ill. 60304; Richard A. Toops, 201 E. Walton, Chicago, Ill. 60611

[21] Appl. No.: 304,863

[22] Filed: Sep. 23, 1981

[51] Int. Cl.[3] ..... A63F 3/00

[52] U.S. Cl. ..... 273/256

[58] Field of Search ..... 273/256, 254, 249–253, 273/243

[56] References Cited

U.S. PATENT DOCUMENTS

| | | | |
|---|---|---|---|
| 3,858,885 | 1/1975 | Adcock | 273/243 |
| 3,884,475 | 5/1975 | Munro et al. | 273/256 |
| 4,114,891 | 9/1978 | Lawrimore | 273/250 |

FOREIGN PATENT DOCUMENTS

| | | | |
|---|---|---|---|
| 2430247 | 2/1980 | France | 273/254 |

*Primary Examiner*—Richard C. Pinkham
*Assistant Examiner*—Scott L. Brown
*Attorney, Agent, or Firm*—Robert E. Browne; Alan L. Barry

[57] ABSTRACT

A game board includes a peripheral zone defining a plurality of spaces to be occupied by participant symbols and a plurality of substantially identical internal zones each representing a different currency and having a plurality of spaces defining a path which may be occupied by other participant symbols. Each of the peripheral spaces has instructions for the participants and additional cards are provided with additional instructions, such as revalution or devalution of the currencies.

3 Claims, 4 Drawing Figures

BOARD GAME

DESCRIPTION

1. Technical Field

The present invention relates generally to game boards and, more particularly, to a game having instructional value for use of different currencies of different countries.

2. Background Prior Art

Many educational and amusement games have been devised which employ a board that permits the participant to play a game which simulates some real aspect of life. Examples of such devices are disclosed in U.S. Pat. Nos. 3,860,242 and 4,054,289. Another game that has achieved a remarkable degree of commercial success is known as "Monopoly", which utilizes paper currency for purchasing and selling properties on the game board.

Manufacturers of such games are constantly looking for new games that provide entertainment and intellectual challenge, while at the same time involving substantial interest, mental stimulation, educational experience and enjoyment.

SUMMARY OF THE INVENTION

According to the present invention, a game has been developed which is designed to educate the participant or player in currency equivalents of several different currencies from several different countries. More specifically, the game includes a game board having a peripheral zone which is divided into a plurality of spaces and a plurality of internal zones having a plurality of spaces defining a path. At least one of the spaces in each zone represents a purchasable item which must be purchased in a currency for that zone. The game also includes a movable master piece movable into any one of the second playing zones, an assistant piece for each player movable along the first playing zone, and a plurality of aide pieces respectively movable along any one of the paths. The peripheral first playing zone spaces each having an instructional message for the player and the game includes a plurality of instructional message cards designating instructions to a player when an identifying piece for a player lands on selected peripheral spaces.

Many of the instructional cards relate to revaluing of each of the currencies when selected, as will be described later.

BRIEF DESCRIPTION OF SEVERAL VIEWS OF DRAWINGS

DETAILED DESCRIPTION

Figure 1:
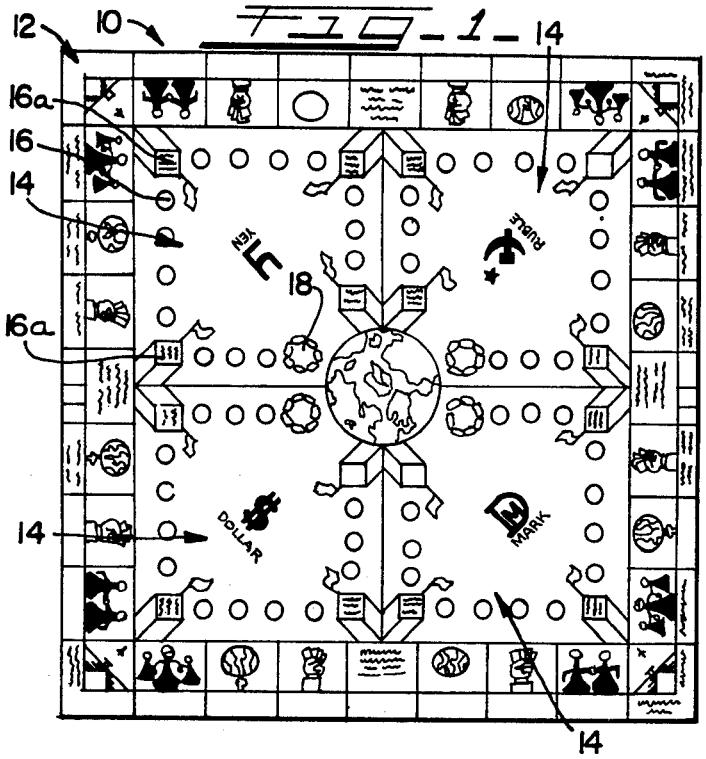
FIG. 1 is a plan view of the game board constructed in accordance with the teachings of the present invention.
Figure 3:
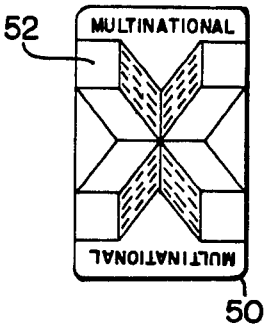
FIG. 3 is one side view of one of a plurality of cards utilized with the game showing the symbol associated with the game; and, FIG. 4 is an opposite face of a card designating one type of instruction.
Figure 4:
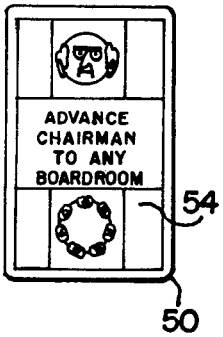
Figure 2:
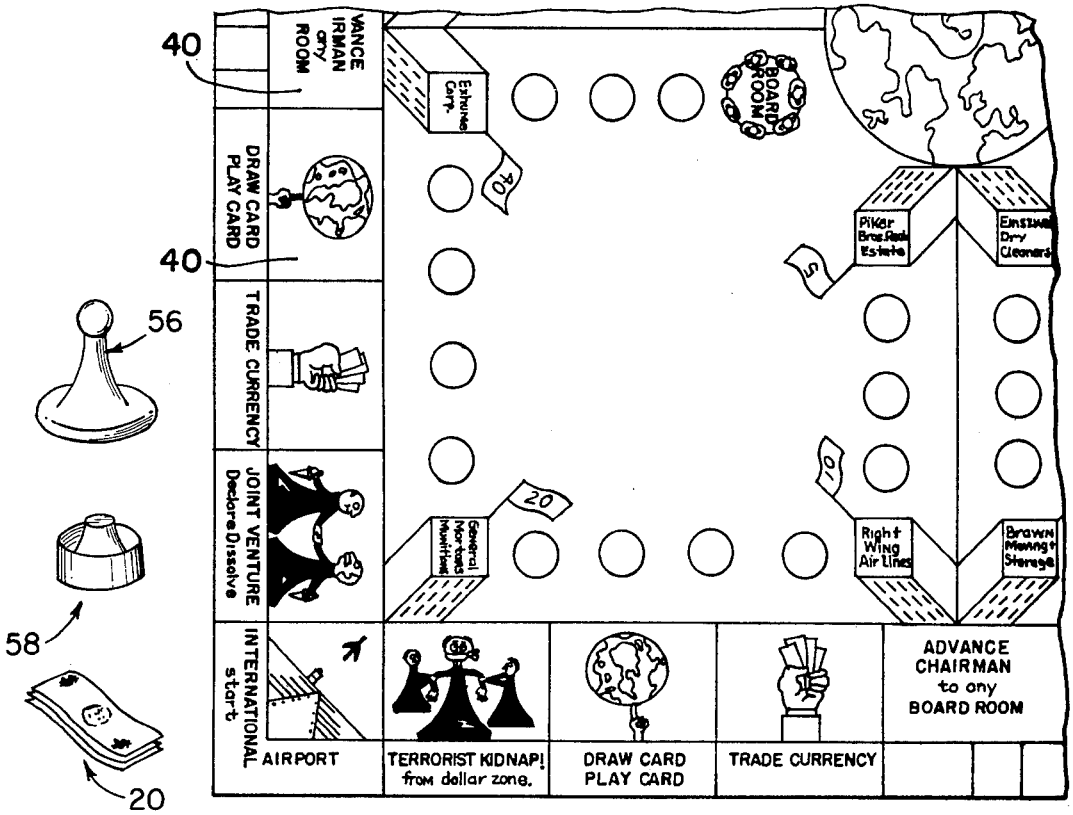
FIG. 2 is an enlarged fragmentary plan view of one segment of the game board illustrated in FIG. 1.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the embodiment illustrated.

FIG. 1 of the drawings discloses a playing board, generally designated by reference numeral 10. Playing board 10 is designed to be folded in half for storage purposes and includes a peripheral zone or first playing zone 12 extending around the perimeter of the game board 10 and a plurality of second or internal zones 14. Each internal zone 14 has a plurality of spaces 16 defining a path having a starting point 18 in each zone. Several of the spaces, such as space **16*a*, are in the form of a saleable item such as a corporation for a value. The value of the respective spaces 16*a* in an internal zone 14 will be different for each space but will also be in the same currency. For example, the first internal playing zone 14 may require purchasing of the item in dollars, while the second may be in the form of Japanese Yen, the third being, for example, Russian Rubles, and the fourth being German Marks. Each of the four sections of the board will be color-coded for a given currency 20**. The significance of these items will become apparent when describing the specific manner of playing the novel game.

The outer peripheral playing zone 12 is divided into a plurality of spaces 40. Each of the spaces 40 around the perimeter of board 12 has instructions thereon for the players or participants. In the preferred embodiment, each of the four sides of the board 12 has repetitive instructions thereon with each of the four corner spaces being a starting point and neutral zone for each of the players. This starting zone is identified as the "International Airport" in the illustrated embodiment. The respective spaces between International Airports on respective corners of the game board define different instructions to the player, preferably as follows:

1. "Terrorist Kidnap"
2. "Draw Card - Play Card"
3. "Trade Currency"
4. "Advance Chairman to Any Boardroom"
5. "Draw Card - Play Card"
6. "Trade Currency"
7. "Joint Venture"

Each of the four sides is color-coded to one of the colors in the respective center zones. The significance of each of the instructions will be brought out more fully in connection with the discussion on how the game is played.

In addition to the instructions around the perimeter of the board, the game also has a plurality of additional instructional cards 50, each of which has a front face 52 which may have the game's insignia thereon, and a bottom face 54 which incorporates the instructions for that specific card.

The copyrighted game is played utilizing the copyrighted instructions, as follows:

AIM OF THE GAME

A player tries to acquire a corporation in each of four areas of the globe. Whoever is first to do this wins the game, becoming the first MULTINATIONAL corporation. But a player must acquire these corporations by payment in the local currency of the area of the board in which they are located. Just as in the real world, one must spend Yen in Japan. To get necessary currency to buy up corporations, a player must trade or exchange his own money for other "foreign" currencies, always seeking to get the best deal possible. He must then travel into the area on the board in which he wishes to purchase a corporation, battling tokens on the board for position and power, always trying to devalue and drive down the wealth of his opponents. But he himself can have money he has worked hard to get suddenly devalue and corporations he has fought hard for bought right out from under him. It's the world of Joint Ventures and International Takeovers, with Billions at stake. It's the newest game in town. MULTINATIONAL!

RULES OF THE GAME

Equipment

The equipment to play MULTINATIONAL consists of a playing board, 30 MULTINATIONAL cards, dice, four world currencies—AMERICAN DOLLAR, JAPANESE YEN, GERMAN MARK, and RUSSIAN RUBLE, each in units of 1, 5, 10, 20, and 50 Billion, four CHAIRMEN OF THE BOARD tokens, four "RIGHT HAND MAN" tokens, and AIDES in four color groups.

Set-Up

Each player chooses to play from one of the 4 currency zones on the board and starts his token in front of that zone's INTERNATIONAL AIRPORT. His CHAIRMAN, not yet in play, is kept off the board. A banker is chosen by the players to preside over GLOBEX BANK. Each player is given currency in the amount of 40 Billion of the zone from which he has decided to play. The player playing the Yen, for example, would receive 40 Billion Yen. Each player plays with one die. Take the MULTINATIONAL deck of cards and remove the 4 "PARITY" cards. Shuffle the deck and deal each player 3 cards, face down. (A player should not let other players see his cards until they are played.) Then return the "PARITY" cards to the remainder of the deck, shuffle, and place the deck face down in the center of the board. Each player is given his color group of AIDES.

MOVEMENT OF PIECES

If one takes a quick look at the Board, it is quite easy to understand the movement of pieces or tokens. The Board has an outer area of squares with instructions and an inner area of different colored zone that contain corporate buildings. A player's main token 56 or RIGHT HAND MAN travels around the outer Board and does the work, the player following the instructions of the square the token 56 lands on. The CHAIRMAN OF THE BOARD can move to any BOARD ROOM, but only when his hard-working RIGHT-HAND MAN makes it possible. And when the CHAIRMAN sits in a BOARD ROOM—little pieces 58, or AIDES, can then travel over the circled path trying to land on the Buildings. In all instances in this game, any token (Right-Hand Man, Chairman, or Aide), landing on another "bumps" that piece off the board and takes its place.

STARTING THE GAME

The player to start is the one with the highest roll of the die. When he finishes his turn, play passes to his left. Only one roll per turn. On the first turn each player advances his main token 56 (Right-Hand Man) from the INTERNATIONAL AIRPORT, counting it as the first space. The RIGHT-HAND MAN can move in either direction, one direction per turn and only on the spaces around the outer board, in contrast to the CHAIRMAN, who can never be advanced on his own but who throughout the game is shuttled to BOARD ROOMS, while the RIGHT-HAND MAN does all the work.

A player's token must use the full count on the die; what he can do when the token lands at the end of the count, depends on the space. As to each space, the following rules apply:

Draw Card-Play Card

When a player's token lands on this square, a card must be drawn from the top of the MULTINATIONAL deck in the center of the board, and a card must be played, either the one drawn or one already in the player's hand. If the card drawn is not played, it is kept in the player's hand, replacing the card that is played. If the "PARITY" card is drawn, however, it must be played when drawn, and can never be kept by a player in his hand.

Most cards either revalue or devalue one currency, stating right on the card which currency it affects. To "play" one of these cards, place the card face up in the center of the currency zone to which the card applies or in the center of any zone of your choice, if it is a wild card. Doing so ends a player's turn. The card, however, remains in play on the board and continues to revalue or devalue the currency of the zone. When a currency is revalued, it will buy more of the other currencies of the world. So a card that says "MARK BUYS 2X", if played (by placing it in the center of the Mark zone,) will enable a player who has Marks to get—for every 1 Billion Marks he trades—2 Billion units of another currency. When a currency is devalued, it will buy less of the other currencies of the world. So a card that says "Mark Buys ½," if played, means that someone who has Marks must now trade 2 Billion Marks for every 1 Billion of any other currency in the world.

A card remains in play on the board either until it is superceded by a later card played in the zone, in which case the earlier card is returned to the bottom of the MULTINATIONAL deck, or until a "PARITY" card is drawn, in which case, all cards on the board are removed from the zones and returned to the bottom of the deck. After a "PARITY" card has been played, any player who so desires can call for a fast shuffle before the cards are returned to the middle of the board.

Trade Currency

When a token lands on this square, a player is permitted to make a "currency trade". What currency he may trade for is denoted by the color of the square on which his token has landed (e.g., if Green, then Dollars can be traded for, if Red, Rubles . . . , etc.). If a player wishes to make no trade, he passes, his turn ending. Only one trade is allowed per turn.

A "currency trade" is a simple exchange of one currency for another between the player trading and the GLOBEX BANK. All trades, in any amount and for any currency, are made with the BANK. In every trade, a currency desired by the player is received from GLOBEX in exchange for another currency the player is prepared to part with. If a player wants Yen, to get it he must part with some of his Marks, or his Dollars, or his Rubles. How much he parts with depends on how much Yen he wants to get, and on what card is in play in the zone of the currency he parts with. If no card is in play in that zone, then the BANK will return an equal amount of the desired currency to the player as was exchanged. If a revaluing card is in play in the zone of the currency the player is parting with, then the BANK will return twice as much desired currency as was exchanged, and if a devaluing card in in that zone, then the BANK will return only half as much to the player as was exchanged. To illustrate, let's suppose a player wanting 20 Billion Yen has maneuvered his token on to a Yellow TRADE CURRENCY square. He can now trade for Yen. Suppose he has Dollars to exchange. To get the 20 Billion Yen he will exchange 20 Billion Dollars (an even trade) if there is no card in play in the Dollar Zone. If a revaluing card (2X) is in play in the Dollar Zone, he exchanges only 10 Billion Dollars for the 20 Billion Yen, and if a devaluing card (½) is in the Dollar Zone, he must exchange 40 Billion Dollars to get 20 Billion Yen. No consideration is given to what card might be in the Yen Zone at the time of this trade because only cards in play for the currency parted with (Dollars) affect the rate of exchange with GLOBEX.

There is no limit to the amount of desired currency a player can trade for.

Advance Chairman To The Boardroom

To purchase a corporation, a player's CHAIRMAN OF THE BOARD must be physically present in the BOARD ROOM of the zone where the corporation is located. When his "RIGHT-HAND MAN" token lands on an ADVANCE CHAIRMAN TO BOARD ROOM space, the player may on that turn locate his CHAIRMAN in any area's BOARD ROOM he wishes. (In addition to this space, included in the MULTINATIONAL deck are 8 cards which also permit a player to move his CHAIRMAN to any BOARD ROOM. These cards are played when a player's token lands on the "DRAW CARD" space, as covered earlier. The CHAIRMAN is simply placed in a BOARD ROOM upon playing of the card.) The move of a CHAIRMAN to a particular BOARD ROOM, will result in any CHAIRMAN who happens to already be in that BOARD ROOM being "bumped," in which case the deposes CHAIRMAN is returned to his player (off the board) where he remains until his "Right-Hand Man" again makes it possible for him to return to a BOARD ROOM.

Terrorist Kidnaps!

Being a figure of great importance, any time he is physically in a zone's BOARD ROOM, a CHAIRMAN runs the risk of being abducted by others bent on deeds of international terrorism. If, when a CHAIRMAN sits in a zone's BOARD ROOM, an opponent lands on the KIDNAP! space of that zone, then the CHAIRMAN is kidnapped from the BOARD ROOM and literally removed by the opponent. Immediately a player must help his CHAIRMAN "escape". He does this, immediately after a kidnapping—out of turn, by trying to roll 7 or 11 in three tries of the dice. If he succeeds, his CHAIRMAN escapes and is returned immediately to him without his paying a ransom. However, if he fails to roll 7 or 11 in three tries, he must immediately pay to the opponent a ransom of half (50%) his currency of the zone from which his CHAIRMAN was kidnapped before the CHAIRMAN is returned. If a player has an uneven amount of currency such as 7 Billion, he would pay ransom of the greater half, or 4 Billion. If a player has no currency of that zone, he must pay 1 Billion of any currency he has that the opponent designates.

International Airport

When a player's token lands at INTERNATIONAL AIRPORT on his dice roll, he may use the Airport to fly to any other Airport, on that turn. A player can not fly from the Airport if his token has already been resting at the Airport prior to his roll.

ZONE PLAY—WINNING THE GAME

The ultimate aim of the game is for your budding MULTINATIONAL to buy up one corporation in each colored Zone. Whoever is first to have one corporation in each Zone wins! Again, all purchases must be made in the local currency of each zone, and a player can buy more than one corporation in each zone if he wishes, but he must have at least 4 (1 in each zone) to win the game. The corporations are located along a circled path in each zone. Zone play concerns the movement of the AIDE—the penny sized disc of a player's color, through the zones in a player's quest to buy or takeover these corporations, represented by buildings. Moving the AIDE, however, is possible only when a player's CHAIRMAN visits a BOARD ROOM in a particular zone. Once a CHAIRMAN is in a BOARD ROOM, a player may, on his turn—rolling the die—, introduce one of his AIDES into that zone by advancing it along the path—beginning from the BOARD ROOM—which takes it to the different buildings in the zone. An AIDE can be advanced along the path on a roll of the die only when his CHAIRMAN sits in that zone's BOARD ROOM; the CHAIRMAN himself never moves along the path. The CHAIRMAN merely sits in the BOARD ROOM. If a CHAIRMAN is for some reason removed from the BOARD ROOM, the AIDE in that zone cannot move again until his CHAIRMAN returns.

To get to buy a corporation, an AIDE must land on a corporate building, but a player here need not roll an exact count on the die. That is, if an AIDE sits 3 spaces from a building and the player rolls 5, he may ignore the last 2 counts, landing on and buying the corporation. If he does not intend to buy, however, his AIDE must use the full count on the die when he advances. To buy a corporation, a player pays the BANK, in the proper currency, the amount indicated on the building's flag, leaving the AIDE on the building to now signify his ownership. A building, then, may not be landed on unless the player buys it on that turn; if he does not wish to buy, he must move the AIDE the full count on the die, or must move another token. Any AIDE resting on a building top signifies ownership and the player is assumed to have paid for it.

AIDES that are still on the path, like any token, are "bumped" off the board when they are landed on by an opponent, but an AIDE that sits on a building and signifies ownership cannot be "bumped". It can, however, be removed by a TAKEOVER. A TAKEOVER of a corporation may occur only if a player's AIDE lands exactly (using the full count of a dice roll) on a previously purchased building—and—by making the "stockholders" a deal they cannot refuse, pays the owner double the stated board purchase price in the proper currency. The former owner, after receiving this money, pays the BANK half (½) of it for corporate taxes. The new owner's AIDE is then placed on the building and the former owner's AIDE is removed from the board. A TAKEOVER must be tendered immediately when a player's AIDE lands on a building; as in a regular purchase a building may not be landed on unless the player effects the TAKEOVER purchase on that turn. A TAKEOVER is both an offensive and defensive move in one. A player ends up with one new building, while his opponent has one less. A player can (usually to raise money) sell out a corporation he has previously bought, only on his turn before his rolls the dice. He sells to the BANK which refunds the stated board purchase price in the proper currency. He moves his AIDE off the building and off the board, and then goes on with his turn.

AIDES may move forward or backward, but only one direction a turn.

A player may have only one AIDE moving on the path of each zone. He may not enter a second AIDE from a zone's BOARD ROOM until the first AIDE in that zone has purchased a building, or has been Joint Ventured. A player may, however, enter any number of AIDES by use of the Joint Venture.

JOINT VENTURE

An important way to get an AIDE Into a zone can occur when a player lands his token on the JOINT VENTURE space. In that zone only the player can place on of his AIDES on top of any other player's AIDE that happens to be on the pathway (not on a building) in that zone, and thereby declare a "Joint Venture". There is no limit to the number of partners in a Joint Venture, so any other players landing a token on that JOINT VENTURE space may also join by adding their AIDE to the pile of Joint Ventured AIDES on that path. Any player who is a partner of a Joint Venture on his dice roll may move the Joint Ventured AIDES so long as any one of their CHAIRMEN is in that zone's BOARD ROOM. Joint Ventured AIDES are moved along the path just as if they wre a single AIDE, except they must always move the full count of the dice and cannot, like single AIDES, cut short the count if they reach a building a partner seeks to buy. When Joint Ventured AIDES—using the full dice count—land on a building exactly, it is the partner who rolls the dice to exactly bring the AIDES to the building who get to buy it. The other AIDES are returned to their players, the Joint Venture ceasing to exist. In the same way, Joint Ventured AIDES can also land on owned buildings and effect a TAKEOVER, with again only the partner who rolls the exact count needed getting to buy.

Joint Ventured AIDES can "bump", and be "bumped" by a single AIDE of other Joint Ventured AIDES. Like single AIDES, they can move backward and forward, but only one direction a turn.

As a way to buy a corporation, the Joint Venture is an offensive tactic that quickly gets a player's AIDE into a zone; as a way to manipulate an opponent's AIDE, it is a defensive tactic that can keep an opponent from reaching a building, and which forces him to have to land exactly on it to purchase it! Any member of a Joint Venture can likewise Dissolve it by also landing on the same JOINT VENTURE space. He may then remove from the pile of Joint Ventured AIDES all AIDES except his own. Although a player may have no more than one single AIDE entered and moving on the path of each zone, there is no limit to the number of Joint Ventures he may be involved in. Therefore, if he succeeds in dissolving Joint Ventures, he may be left with more than one single AIDE on the path in each zone, and he may move any of these pieces when his CHAIRMAN visits their BOARD ROOMS.

In summary, the present invention involves a game that is of educational value for learning the significance of the value of different currencies in relation to the Dollar. The game provides enjoyment for as many as four players and develops mental stimulation.

Of course, numerous modifications come to mind without departing from the spirit of the invention. For example, the number and type of spaces in the peripheral playing area could be varied. Also, the number of internal playing zones could be increased or decreased and the configuration of the board could be other than rectangular.

We claim:

1. An apparatus for playing a game comprising:

a board defining a flat playing surface having (a) a peripheral zone being divided into a repetitive set of spaces, each of said spaces having an instructional message; and, (b) a plurality of internal zones defining separate playing areas and placed within said peripheral zone, each internal zone being independent from another internal zone and from said peripheral zone, each internal zone having a plurality of spaces defining a closed path discontinuous from the spaces of said peripheral zone and from other internal zone paths, each internal zone representing a given international currency with at least one of said spaces in each internal zone representing an asset purchaseable in the currency of the internal zone;

a first identifying marker for each player along said peripheral zone spaces;

second identifying markers for the paths of any one of said internal zone spaces;

a given quantity of pieces of simulated paper money corresponding to a given international currency of said internal zone;

a plurality of playing cards bearing written instructions for varying the quantity of simulated paper money of a designated international currency being held by players, the instructional cards being accessible when said first identifying marker lands on selected peripheral zone spaces; and, means for randomly selecting a number to advance movement of said first identifying marker around said peripheral zone.

2. The apparatus for playing a game described in claim 1 wherein one set of repetitive peripheral zone spaces is associated with each internal zone.

3. The apparatus for playing a game described in claim 1 wherein said board includes four internal zones.

* * * * *